US006181245B1

(12) United States Patent
Copeland et al.

(10) Patent No.: US 6,181,245 B1
(45) **Date of Patent: *Jan. 30, 2001**

(54) MAGNETOMECHANICAL ELECTRONIC ARTICLE SURVEILLANCE MARKER WITH BIAS ELEMENT HAVING ABRUPT DEACTIVATION/MAGNETIZATION CHARACTERISTIC

(75) Inventors: Richard L. Copeland, Boca Raton, FL (US); Kevin R. Coffey, Morgan Hill, CA (US)

(73) Assignee: Sensormatic Electronics Corporation, Boca Raton, FL (US)

( * ) Notice: Under 35 U.S.C. 154(b), the term of this patent shall be extended for 0 days.

This patent is subject to a terminal disclaimer.

(21) Appl. No.: 08/912,058

(22) Filed: Aug. 15, 1997

Related U.S. Application Data

(63) Continuation-in-part of application No. 08/697,629, filed on Aug. 28, 1996, now Pat. No. 5,729,200.

(51) Int. Cl.[7] ..... G08B 13/24

(52) U.S. Cl. ..... 340/551; 340/577.3

(58) Field of Search ..... 340/551, 572.3

(56) References Cited

U.S. PATENT DOCUMENTS

| | | | | |
|---|---|---|---|---|
| 4,510,489 | | 4/1985 | Anderson, III et al. | 340/572 |
| 4,510,490 | | 4/1985 | Anderson, III et al. | 340/572 |
| 5,469,140 | | 11/1995 | Liu et al. | 340/551 |
| 5,495,230 | | 2/1996 | Lian | 340/551 |
| 5,729,200 | * | 3/1998 | Copeland et al. | 340/551 |
| 5,767,770 | * | 6/1998 | Gadonniex | 340/551 |

* cited by examiner

*Primary Examiner*—Glen Swann
(74) *Attorney, Agent, or Firm*—Robin, Blecker & Daley

(57) ABSTRACT

A material used to form a biasing element for a magnetomechanical EAS marker has a coercivity that is lower than the coercivity of biasing elements used in conventional magnetomechanical markers. The marker formed with the low coercivity material can be deactivated by applying an AC magnetic field at a level that is lower than is required for deactivation of conventional markers. The marker with the low coercivity bias element can also be deactivated when at a greater distance from a deactivation device than was previously practical.

19 Claims, 11 Drawing Sheets

MAGNETOMECHANICAL ELECTRONIC ARTICLE SURVEILLANCE MARKER WITH BIAS ELEMENT HAVING ABRUPT DEACTIVATION/MAGNETIZATION CHARACTERISTIC

REFERENCE TO RELATED APPLICATION

This application is a continuation-in-part of application Ser. No. 08/697,629, filed Aug. 28, 1996, now U.S. Pat. No. 5,729,200.

FIELD OF THE INVENTION

This invention relates to magnetomechanical markers used in electronic article surveillance (EAS) systems.

BACKGROUND OF THE INVENTION

It is well known to provide electronic article surveillance systems to prevent or deter theft of merchandise from retail establishments. In a typical system, markers designed to interact with an electromagnetic field placed at the store exit are secured to articles of merchandise. If a marker is brought into the field or "interrogation zone", the presence of the marker is detected and an alarm is generated. Some markers of this type are intended to be removed at the checkout counter upon payment for the merchandise. Other types of markers remain attached to the merchandise but are deactivated upon checkout by a deactivation device which changes a magnetic characteristic of the marker so that the marker will no longer be detectable at the interrogation zone.

A known type of EAS system employs magnetomechanical markers that include an "active" magnetostrictive element, and a biasing or "control" element which is a magnet that provides a bias field. An example of this type of marker is shown in FIG. 1 and generally indicated by reference numeral 10. The marker 10 includes an active element 12, a rigid housing 14, and a biasing element 16. The components making up the marker 10 are assembled so that the magnetostrictive strip 12 rests within a recess 18 of the housing 14, and the biasing element 16 is held in the housing 14 so as to form a cover for the recess 18. The recess 18 and the magnetostrictive strip 12 are relatively sized so that the mechanical resonance of the strip 12, caused by exposure to a suitable alternating field, is not mechanically inhibited or damped by the housing 14. In addition, the biasing element 16 is positioned within the housing 14 so as not to "clamp" the active element 12.

As disclosed in U.S. Pat. No. 4,510,489, issued to Anderson, et al., the active element 12 is formed such that when the active element is exposed to a biasing magnetic field, the active element 12 has a natural resonant frequency at which the active element 12 mechanically resonates when exposed to an alternating electromagnetic field at the resonant frequency. The bias element 16, when magnetized to saturation, provides the requisite bias field for the desired resonant frequency of the active element. Conventionally, the bias element 16 is formed of a material which has "semi-hard" magnetic properties. "Semi-hard" properties are defined herein as a coercivity in the range of about 10–500 Oersted (Oe) and a remanence, after removal of a DC magnetization field which magnetizes the element substantially to saturation, of about 6 kiloGauss (kG) or higher.

In a preferred EAS system produced in accordance with the teachings of the Anderson, et al. patent, the alternating electromagnetic field is generated as a pulsed interrogation signal at the store exit. After being excited by each burst of the interrogation signal, the active element 12 undergoes a damped mechanical oscillation after each burst is over. The resulting signal radiated by the active element is detected by detecting circuitry which is synchronized with the interrogation circuit and arranged to be active during the quiet periods after bursts. EAS systems using pulsed-field interrogation signals for detection of magnetomechanical markers are sold by the assignee of this application under the brand name "ULTRA*MAX" and are in widespread use.

Deactivation of magnetomechanical markers is typically performed by degaussing the biasing element so that the resonant frequency of the magnetostrictive element is substantially shifted from the frequency of the interrogation signal. After the biasing element is degaussed, the active element does not respond to the interrogation signal so as to produce a signal having sufficient amplitude to be detected in the detection circuitry.

In conventional magnetomechanical EAS markers, the biasing element is formed from a semi-hard magnetic material designated as "SemiVac 90", available from Vacuumschmelze, Hanau, Germany. SemiVac 90 has a coercivity of around 70 to 80 Oe. It has generally been considered desirable to assure that the biasing magnet has a coercivity of at least 60 Oe to prevent inadvertent demagnetization of the bias magnet (and deactivation of the marker) due to magnetic fields that might be encountered while storing, shipping or handling the marker. The SemiVac 90 material requires application of a DC field of 450 Oe or higher to achieve 99% saturation, and an AC deactivation field of close to 200 Oe is required for 95% demagnetization.

Because of the high level required for the AC deactivation field, conventional devices for generating the AC deactivation field (such as devices marketed by the assignee of the present application under the trademarks "Rapid Pad 2" and "Speed Station") have been operated in a pulsed manner to limit power consumption and comply with regulatory limits. However, because the AC field is generated only in pulses, it is necessary to assure that the marker is in proximity to the device at the time when the deactivation field pulse is generated. Known techniques for assuring that the pulse is generated at a time when the marker is close the deactivation device include generating the pulse in response to a manual input provided by an operator of the device, or including marker detection circuitry within the deactivation device. The former technique places a burden on the operator of the deactivation device, and both techniques require provision of components that increase the cost of the deactivation device. Also, even pulsed generation of the deactivation field tends to cause heating in the coil which radiates the field, and also requires that electronic components in the device be highly rated, and therefore relatively expensive.

The difficulties in assuring that a sufficiently strong deactivation field is applied to the marker are exacerbated by the increasingly popular practice of "source tagging", i.e., securing EAS markers to goods during manufacture or during packaging of the goods at a manufacturing plant or distribution facility. In some cases, the markers may be secured to the articles of merchandise in locations which make it difficult or impossible to bring the marker into close proximity with conventional deactivation devices.

OBJECTS AND SUMMARY OF THE INVENTION

It is accordingly an object of the invention to provide a magnetomechanical EAS marker that can be deactivated by application of deactivation fields lower in strength than those required for deactivation of conventional magnetomechanical markers.

It is another object of the invention to provide magnetomechanical EAS markers that can be deactivated using fields that are generated in a continuous rather than pulsed fashion.

It is a further object of the invention to provide magnetomechanical markers that can be deactivated when the marker is more distant from the deactivation device than is possible with conventional magnetomechanical markers and conventional deactivation devices.

It is yet a further object of the invention to provide magnetomechanical markers that can be deactivated more reliably than conventional magnetomechanical markers.

It is still a further object of the invention to provide magnetomechanical markers that can be activated using DC fields that are lower in level than those required to activate conventional magnetomechanical markers.

According to a first aspect of the invention, there is provided a marker for use in a magnetomechanical electronic article surveillance system, including an amorphous magnetostrictive element and a biasing element located adjacent the magnetostrictive element, wherein the marker has a deactivation-field-dependent resonant-frequency-shift characteristic having a slope that exceeds 100 Hz/Oe.

According to a second aspect of the invention, in such a marker formed of an amorphous magnetostrictive element and an adjacent biasing element, the biasing element is formed of a semi-hard magnetic material having a coercivity Hc of less than 55 Oe.

According to a third aspect of the invention, in such a marker formed of an amorphous magnetostrictive element and an adjacent biasing element, the biasing element is formed of a semi-hard magnetic material having a DC magnetization field characteristic such that a DC magnetic field Ha required to achieve saturation of the biasing element is less than 350 Oe.

According to a fourth aspect of the invention, in such a marker formed of an amorphous magnetostrictive element and an adjacent biasing element, the biasing element is formed of a semi-hard magnetic material having an AC demagnetization field characteristic such that an AC demagnetization field Hmd having a peak amplitude of less than 150 Oe, when applied to the biasing element with the biasing element being in a fully magnetized condition, demagnetizes the biasing element to a level that is no more than 5% of a full magnetization level.

In connection with this and other aspects of the invention, it is desirable not only that the biasing element be demagnetizable with lower field levels than in conventional markers, but also that the biasing element be substantially resistant to accidental demagnetization by exposure to low field levels that may be encountered during shipment, storage or handling of the marker. Accordingly, biasing elements demagnetizable by a 150 Oe AC field are arranged to remain stable (i.e., essentially completely magnetized) when the marker is exposed to fields in the range 0–20 Oe. For biasing elements demagnetizable by a 30 Oe AC field (as is contemplated by this invention), the biasing element remains stable when the marker is exposed to fields in the range of 0–4 Oe.

According to a fifth aspect of the invention, such a marker formed of an amorphous magnetostrictive element and an adjacent biasing element has a target resonant frequency which corresponds to an operating frequency of an electronic article surveillance system and the marker has a deactivation-field-dependent resonant-frequency-shift characteristic such that exposing the marker to an AC deactivation field having a peak amplitude no higher than 50 Oe shifts the resonant frequency of the marker from the target resonant frequency by at least 1.5 kHz.

According to a sixth aspect of the invention, there is provided a marker for use in a magnetomechanical electronic article surveillance system of the type which radiates a marker interrogation signal in the form of intermittent bursts at a predetermined frequency, the marker including an amorphous magnetostrictive element and an adjacent biasing element, and the marker having a deactivation-field-dependent output signal characteristic such that exposing the marker to an AC deactivation field having a peak amplitude no higher than 35 Oe causes an A1 output signal generated by the marker to be reduced in level by at least 50% relative to an A1 output signal generated by the marker prior to exposing the marker to such a deactivation field, where an A1 output signal is a signal generated by the marker at a point in time 1 msec after termination of an interrogation signal pulse applied to the marker.

According to a seventh aspect of the invention, in such a marker formed of an amorphous magnetostrictive element and an adjacent biasing element, the biasing element is formed of a semi-hard magnetic material having an AC demagnetization field characteristic such that, if the biasing element is exposed to an AC field having a peak amplitude of 15 Oe when fully magnetized and not mounted in the marker, the AC field causes a substantial reduction in the level of magnetization of the biasing element, but if the biasing element is fully magnetized and is mounted in the marker adjacent the magnetostrictive element, and the AC field of 15 Oe is applied to the marker, then the magnetostrictive element diverts magnetic flux from the biasing element so that the magnetization of the biasing element is substantially unaffected by the AC field.

According to an eighth aspect of the invention, there is provided a method of activating and deactivating an EAS marker for use with a magnetomechanical EAS system, including the steps of providing an EAS marker formed of a magnetostrictive element and a biasing element mounted adjacent the magnetostrictive element, magnetizing the biasing element so that the biasing element provides a magnetic field to bias the magnetostrictive element for resonance at an operating frequency of the EAS system, and deactivating the EAS marker by exposing the marker to an AC field having a peak amplitude of less than 150 Oe. The step of magnetizing the biasing element may be performed either before or after the biasing element is mounted in the marker, and it is contemplated to accomplish the deactivating step using a field having a peak amplitude of less than 100 Oe.

In accordance with the principles of the present invention, magnetomechanical markers are constructed using control elements that have a relatively low coercivity, and the resonant frequency of the marker can be shifted rather abruptly by application of a relatively low level AC field. Consequently, there can be a reduction in the level of field generated by marker deactivation devices and, with the lower field level, it is feasible to generate the deactivation field continuously, rather than on a pulsed basis as in conventional deactivation devices. It therefore is no longer necessary to provide marker detection circuitry in the deactivation device, nor to require an operator of the deactivation device to manually actuate a deactivation field pulse when the marker to be deactivated is placed adjacent to the deactivation device.

Also, because of the lower deactivation field made possible by the present invention, deactivation devices can be manufactured using components that have lower rated values than components that are used in conventional deactivation devices, so that additional cost savings can be realized.

Furthermore, with the more easily deactivated markers formed in accordance with the principles of the invention, deactivation can be reliably performed even when the marker is at some distance, perhaps up to one foot, from the deactivation device. This capability is especially suitable for deactivation of markers that have been embedded or hidden in an article of merchandise as part of a "source tagging" program.

The foregoing and other objects, features and advantages of the invention will be further understood from the following detailed description of preferred embodiments and practices thereof and from the drawings, wherein like reference numerals identify like components and parts throughout.

DESCRIPTION OF PREFERRED EMBODIMENTS AND PRACTICES

Figure 1:
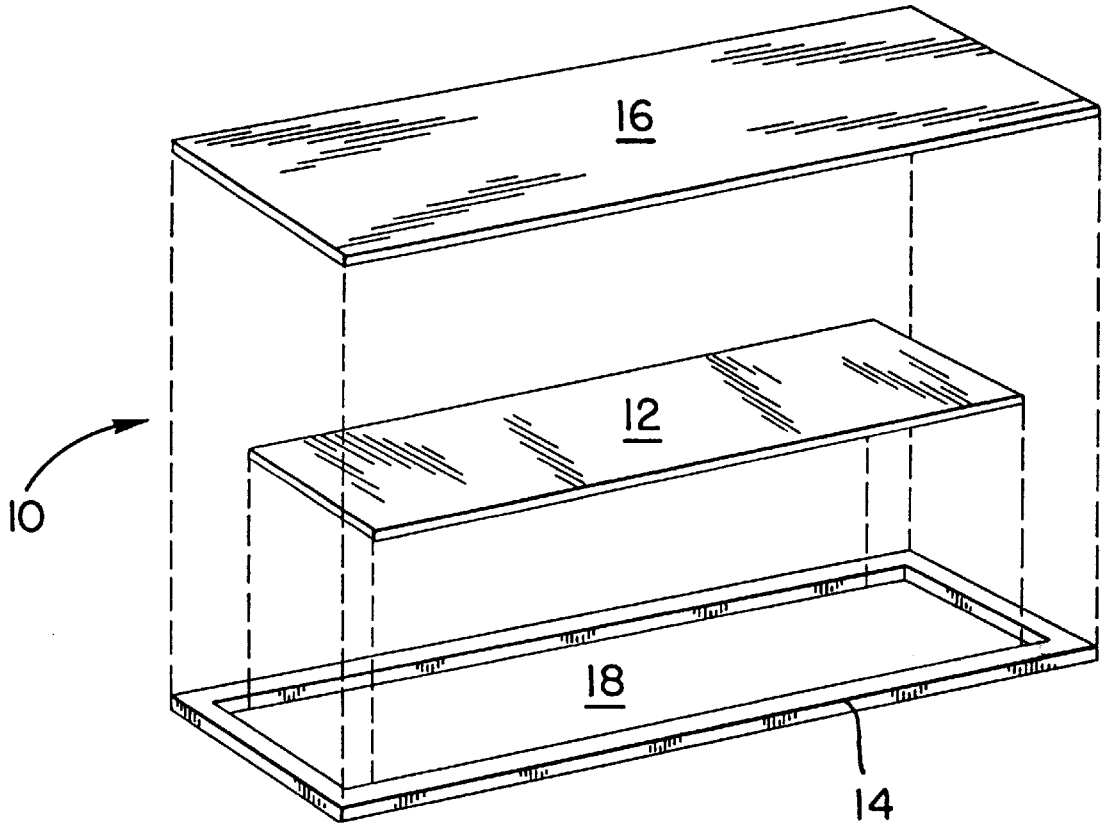
FIG. 1 (PRIOR ART)
FIG. 1 is an isometric view showing components of a magnetomechanical marker provided in accordance with the prior art.

In accordance with the invention, a marker like that described above in connection with FIG. 1 is formed, using as the biasing element 16 a relatively low coercivity material such as the alloy designated as "MagnaDur 20-4" (which has a coercivity of about 20 Oe and is commercially available from Carpenter Technology Corporation, Reading, Pa), instead of the higher-coercivity conventional materials such as SemiVac 90. MagnaDur 20-4 essentially has the composition $Fe_{77.54}Ni_{19.28}Cr_{0.19}Mn_{0.31}Mo_{2.38}Si_{0.30}$ (atomic percent). In a preferred embodiment of the invention, the active element 12 is formed from a ribbon of amorphous metal alloy designated, for example, as Metglas 2628CoA, commercially available from AlliedSignal, Inc., AlliedSignal Advanced Materials, Parsippany, N.J. Other materials exhibiting similar properties can be used for active element 12. The 2628CoA alloy has a composition of $Fe_{32}Co_{18}Ni_{32}B_{13}Si_5$. The 2628CoA alloy is subjected to a continuous annealing process, in which the material is first annealed at a temperature of 360° for about 7.5 seconds in the presence of a transversely-applied 1.2 kOe DC magnetic field, and then is annealed for an additional period of about 7.5 seconds at a cooler temperature under substantially the same transversely-applied field. The two-stage annealing is advantageously performed by transporting a continuous ribbon through an oven in like manner with the process described in co-pending patent application Ser. No. 08/420,757, filed Apr. 12, 1995, and commonly assigned with the present application. The active element 12 is of the type used in a marker sold as part number 0630-0687-02 by the assignee of the present application.

Figure 2:
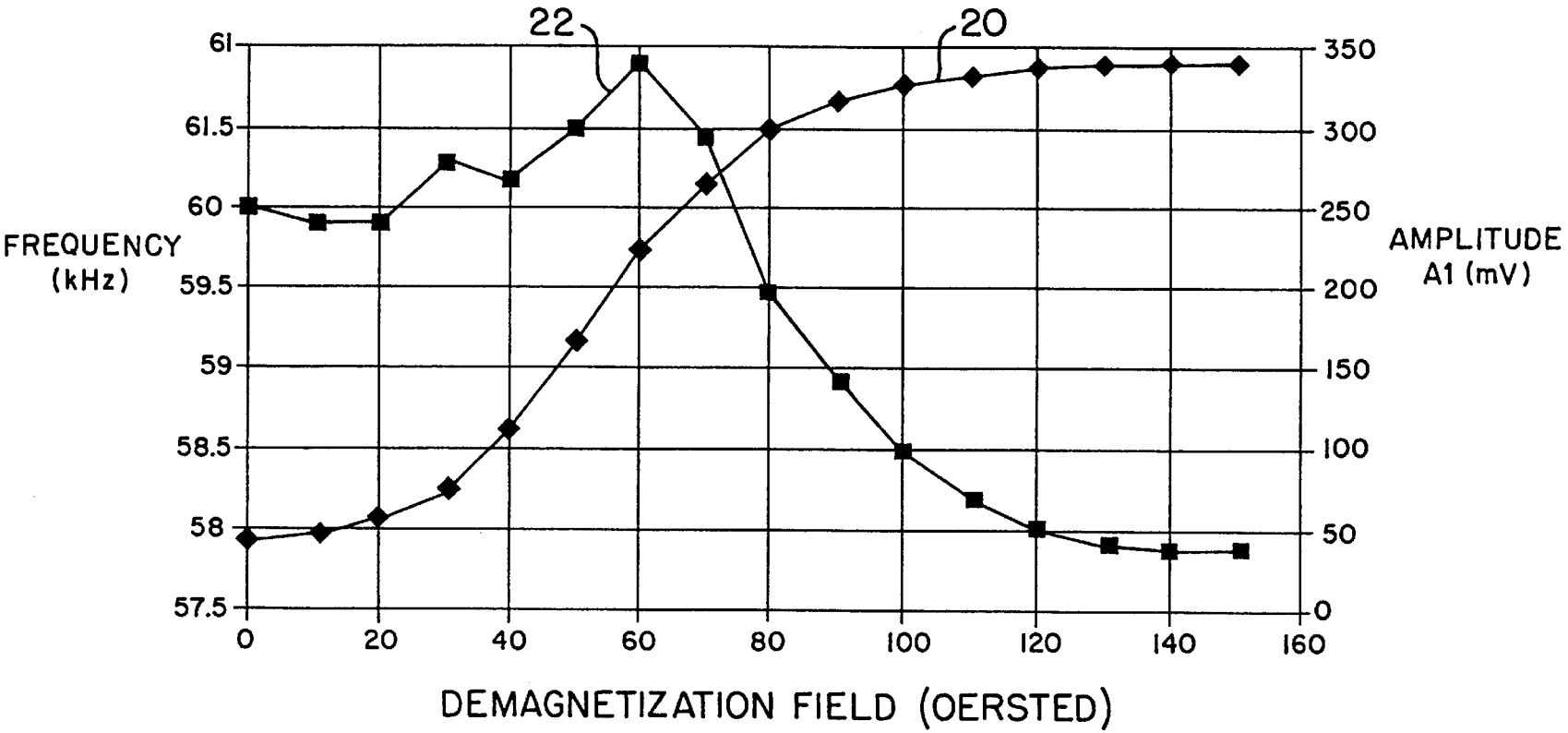
FIG. 2 (PRIOR ART)
FIG. 2 is a graph showing how the resonant frequency and output signal amplitude of a conventional magnetomechanical marker are changed according to the strength of a demagnetization field applied to the marker.
Figure 3:
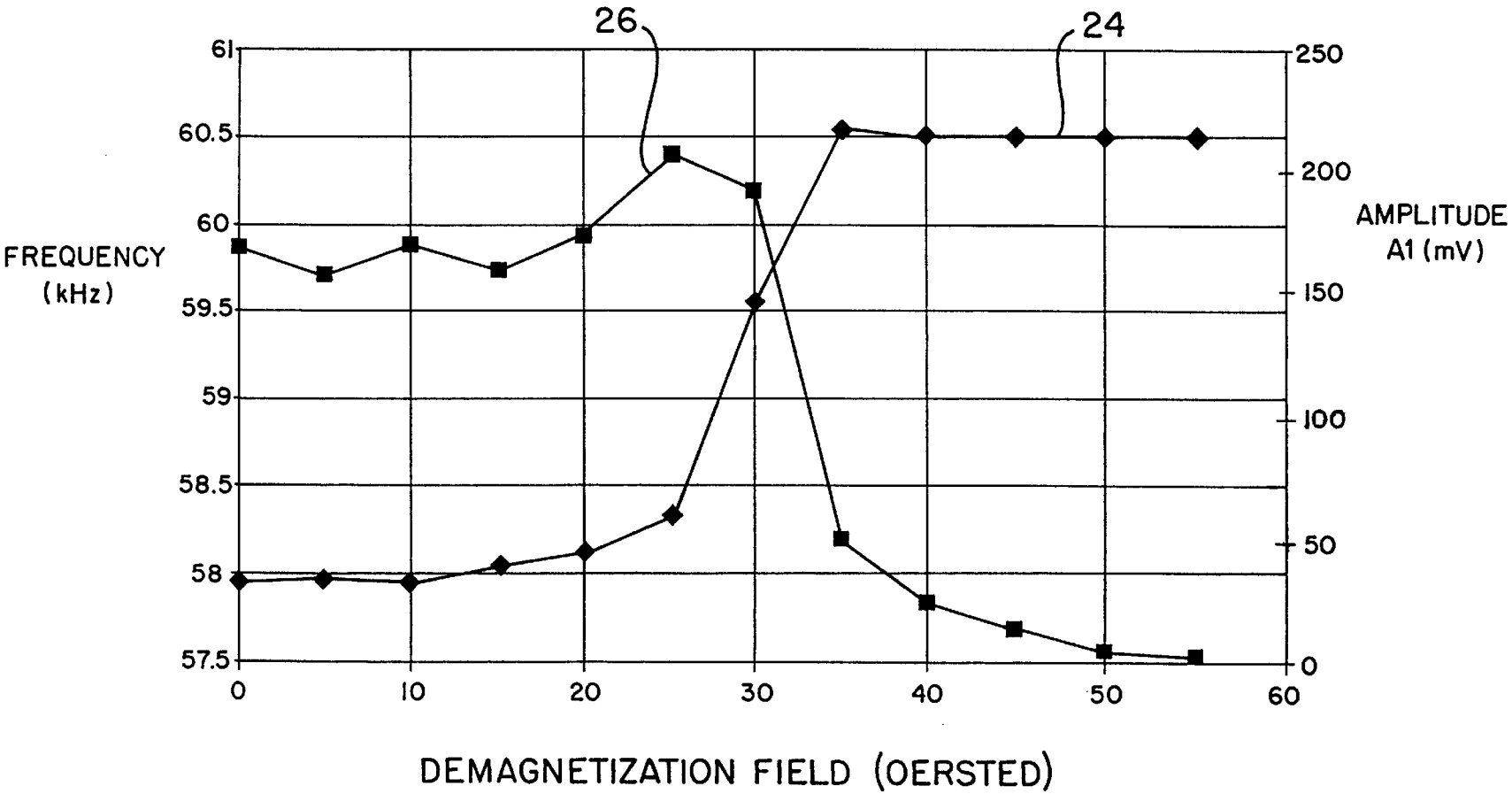
FIG. 3 is a graph similar to FIG. 2, but showing changes in resonant frequency and output signal amplitude for a marker provided in accordance with the present invention, according to the strength of the applied demagnetization field.

FIG. 2 illustrates characteristics of a known magnetomechanical marker in which the 2628CoA alloy, after treatment as described above, is used as the active element and SemiVac 90 is used as the bias element. By way of comparison, FIG. 3 illustrates characteristics of the marker provided in accordance with the present invention in which the MagnaDur 20-4 material is used as the bias element in place of SemiVac 90.

In FIG. 2 reference numeral 20 indicates a curve which represents a resonant-frequency-shift characteristic of the conventional marker, showing changes in the resonant frequency of the marker according to the strength of a demagnetization field applied to the marker. The demagnetization field may be an AC field, or may be a DC field applied with an orientation opposite to the orientation of magnetization of the bias element. If the demagnetization field is an AC field, the indicated field level is the peak amplitude. The curve 20 is to be interpreted with reference to the left hand scale (kilohertz) of FIG. 2.

Reference numeral 22 indicates an output signal amplitude characteristic of the conventional marker, also dependent on the strength of the applied demagnetization field. Curve 22 is to be interpreted with reference to the right hand scale (millivolts) of FIG. 2. The term "A1" seen at the right-hand scale of FIG. 2 is indicative of the output signal level produced by the marker at a time that is 1 msec after termination of a pulse of an interrogation signal applied to the marker at the marker's resonant frequency as indicated at the vertically corresponding point on curve 20. The resonant frequency of the marker prior to deactivation is 58 kHz, which is a standard frequency for the interrogation field of known magnetomechanical EAS systems.

Among other notable characteristics of the data presented in FIG. 2, it will be observed that for demagnetization fields of 50 Oe or less, the resonant frequency of the conventional marker is shifted by less than 1.5 kHz. Moreover, in order to achieve maximum shift in the resonant frequency from the standard operating frequency 58 kHz, and maximum suppression of the output signal amplitude, it is necessary to apply a demagnetization field of about 140 to 150 Oe.

In FIG. 3, reference numeral 24 represents the demagnetization-field-dependent resonant-frequency-shift characteristic curve for a marker provided in accordance with the present invention, with the MagnaDur material used as a bias element. Curve 26 represents the demagnetization-field-dependent output signal characteristic of the marker provided according to the invention. The output levels shown by curve 26 are in response to interrogation signals produced at the resonant frequency indicated at a corresponding point on the curve 24.

One important point about the characteristics shown in FIG. 3 is that a maximum resonant frequency shift, to about 60.5 kHz, is obtained with application of a demagnetization field at a level as low as 35 Oe. The abruptness or steepness of the frequency-shift characteristic curve 24 in FIG. 3 is also notable: at its steepest point, the curve 24 has a slope in excess of 200 Hz/Oe. By contrast, at no point does the curve 20 of FIG. 2 have a slope that exceeds about 60 Hz/Oe. The slope of the curve 20 is well below 100 Hz/Oe at all points.

Figure 4:
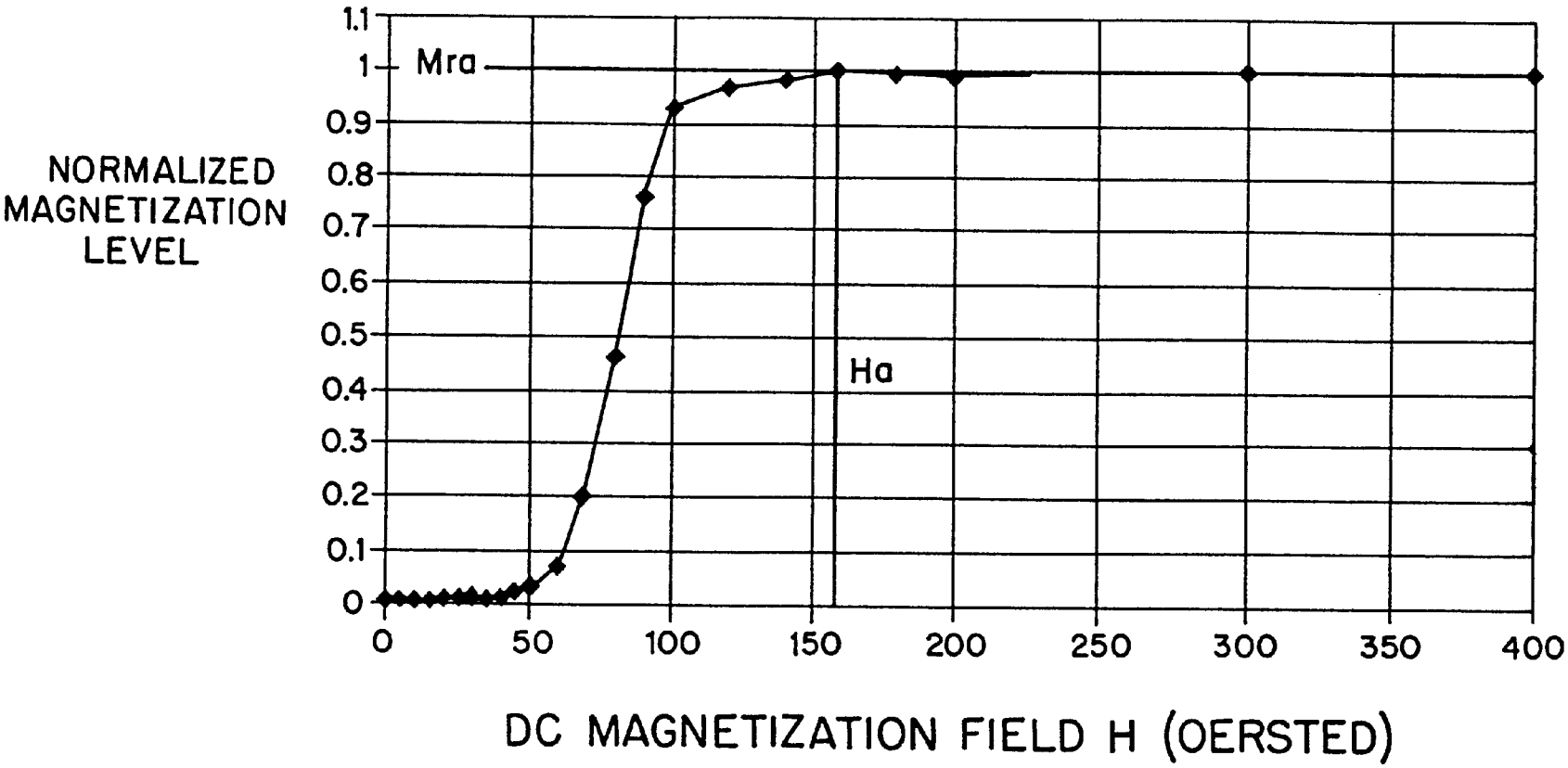
FIG. 4 is a graph which shows how a magnetization level changes, depending on the strength of an applied DC magnetization field, with respect to a material used in accordance with the present invention as a bias element in a magnetomechanical marker.
Figure 5:
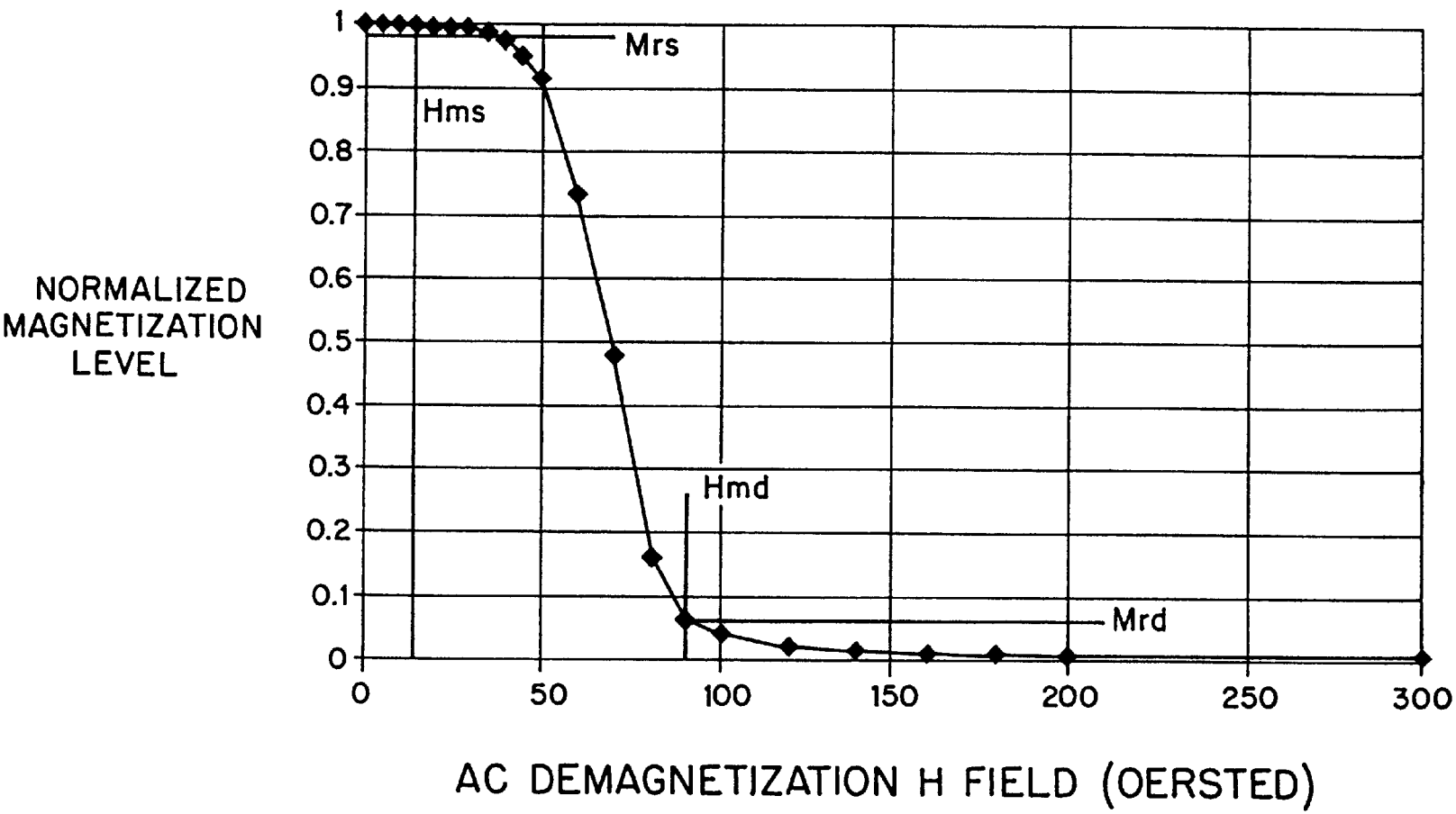
FIG. 5 is a graph which shows variations in magnetization level depending on the strength of a AC demagnetization field applied to a fully magnetized element used in accordance with the invention as a biasing element in a magnetomechanical marker.

FIGS. 4 and 5 respectively represent magnetization and demagnetization characteristics of the MagnaDur material used as a bias element in accordance with the invention.

In FIG. 4, Mra represents a saturation magnetization level for the material, and Ha is the DC magnetic field strength required to induce saturation in the material.

As shown in FIG. 4, a DC magnetization field of about 150 Oe, if applied to the MagnaDur material in an unmagnetized condition, results in substantially complete magnetization of the material. By contrast, a DC field of 450 Oe or stronger is required to fully magnetize the Semivac 90 material.

In FIG. 5, Mrs represents a level of magnetization that is 95% of the saturation, and Hms is a level of an AC field which, when applied to the material in a saturated condition, does not cause the material to be demagnetized to a level below 95% of saturation. Further, Mrd represents a level of magnetization that is 5% of saturation, and Hmd is a level of an AC field which, when applied to the material in a saturated condition, demagnetizes the material to 5% of saturation or below.

As seen from FIG. 5, a fully magnetized biasing element of the MagnaDur material, if subjected to an AC demagnetization field at a level of 100 oe, is demagnetized to below 5% of full magnetization. Also, the MagnaDur material has a "stable" region for applied AC fields of about 20 Oe or less, so that the magnetization of the material is substantially unaffected as long as the applied AC field is no more than about 20 Oe. As a result, markers incorporating the MagnaDur material as a bias element cannot suffer unintentional demagnetization unless ambient fields of more than 20 Oe are encountered.

With a magnetomechanical marker constructed in accordance with the invention, using a bias element formed of a relatively low coercivity material such as MagnaDur, deactivation can be accomplished using an AC deactivation field that is at a significantly lower level than is required according to conventional practice. Correspondingly, deactivation of the marker formed according to the invention can take place without it being necessary to bring the marker as close to the deactivation device as was previously required. It therefore becomes practical to provide deactivation devices that operate at lower power levels than convention deactivation devices. Because of the lower power level required for deactivation, lower rated components can be employed and the deactivation field can be generated continuously, rather than on a pulsed basis as in conventional deactivation devices. By using a continuous relatively low-level deactivation field, it becomes unnecessary to provide circuitry in the deactivation device for detecting the presence of the marker or for permitting the operator of the device to trigger a deactivation field pulse. This leads to cost savings with respect to the deactivation device, while eliminating the burden on the operator which is present with operator-actuated pulsed deactivation devices.

Also, markers formed with a low coercivity bias element in accordance with the invention can be more reliably deactivated, by use of conventional deactivation devices, than is the case with markers using bias elements formed of SemiVac 90.

The lower field level required for deactivation of the marker provided according to the teachings of this invention also aids in accommodating source tagging practices, because deactivation can be carried out with the marker at a greater distance from the deactivation device than was practical with prior art markers. For example, with the markers provided in accordance with the present invention, it becomes feasible to deactivate markers located at a distance of as much as one foot from the coil which radiates the deactivation field.

According to a second embodiment of the invention, the biasing element 16 is formed of a material that has even lower coercivity than MagnaDur and which lacks the stable response to fields of less than 20 Oe. Specifically, according to the second embodiment the biasing element 16 is formed of an alloy designated as Metglas 2605SB1 621 and commercially available from the above-referenced AlliedSignal Inc. The SB1 material essentially has the composition $Fe_{80.18}Co_{0.20}B_{13.69}Si_{5.82}Mn_{0.11}$ (atomic percent). The material is treated according to the following procedure so that it has desired magnetic characteristics.

A continuous ribbon of the SB1 material is cut into discrete strips in the form of a rectangle, having a length of about 28.6 mm, and a width approximately equal to the active element width. The cut strips are placed in a furnace at room temperature and a substantially pure nitrogen atmosphere is applied. The material is heated to about 485° C. and the latter temperature is maintained for one hour to prevent dimensional deformation that might otherwise result from subsequent treatment. Next the temperature is increased to about 585° C. After an hour at this temperature, ambient air is allowed to enter the furnace to cause oxidation of the material. After one hour of oxidation at 585° C., nitrogen gas is again introduced into the furnace to expel the ambient air and end the oxidation stage. Treatment for another hour at 585° C. and in pure nitrogen then occurs. At that point, the temperature is raised to 710° C. and treatment in pure nitrogen continues for one hour, after which the furnace is allowed to cool to room temperature. Only after cooling is completed is exposure to air again permitted. (In all cases, the temperature figures given above are measured at the samples being treated.)

The resulting annealed material has a coercivity of about 19 Oe and a demagnetization characteristic as shown in FIG.

Figure 6:
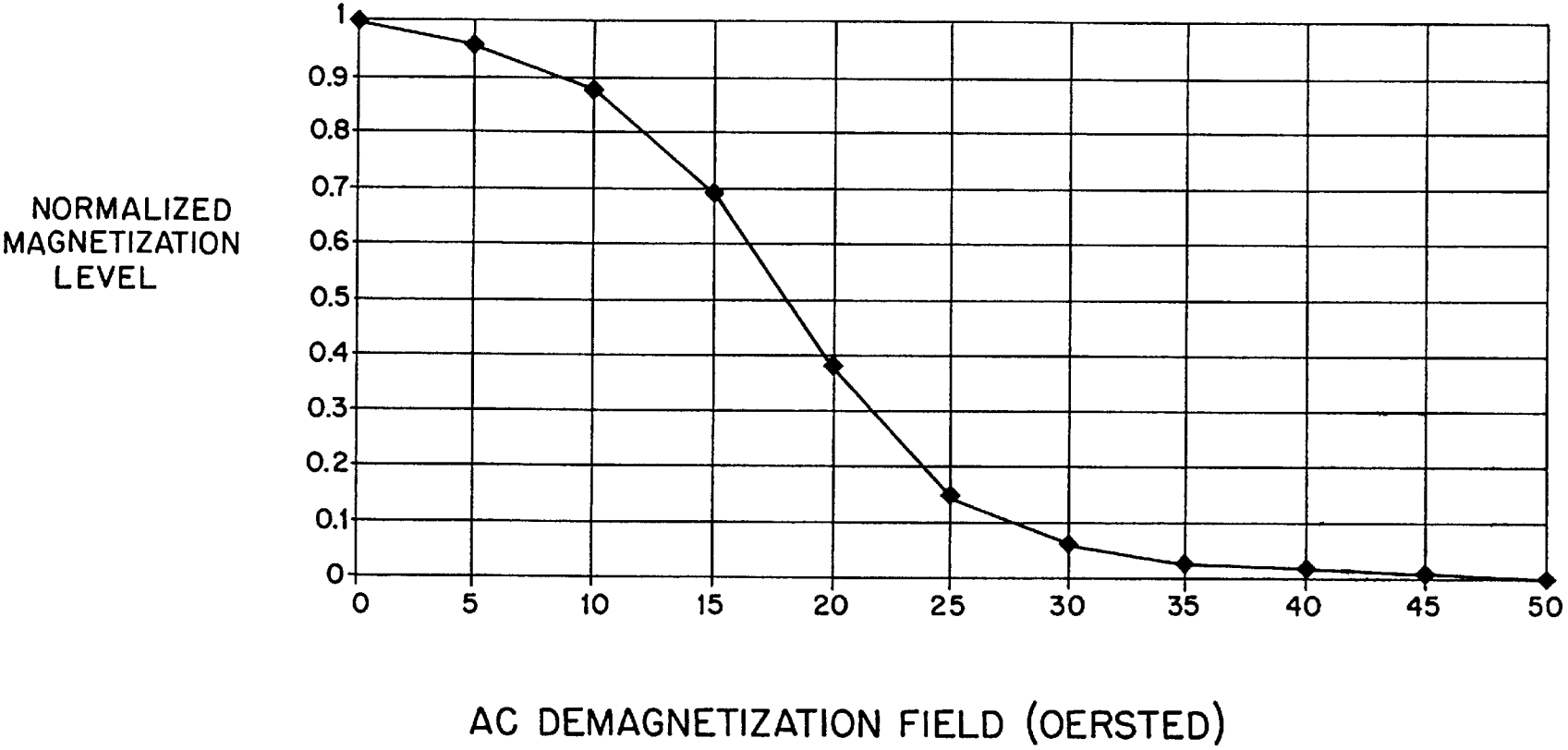
FIG. 6 is a graph similar to FIG. 5, showing resulting magnetization levels according to the strength of the applied AC demagnetization field for a material used as a bias element in accordance with a second embodiment of the invention.

6. It will be observed from FIG. 6 that even an applied AC field as low as 15 Oe results in substantial demagnetization (to about 70% of a full magnetization level) of the annealed SB1 alloy.

Notwithstanding the instability of the SB1 material in the face of rather low level AC fields, the applicants have discovered that when the material is mounted as a biasing element in a magnetomechanical marker in proximity to an active element, the resulting marker has a considerably greater degree of stability upon exposure to low level AC fields than would be anticipated from the demagnetization characteristic of the SB1 material when the material is considered by itself.

Figure 7:
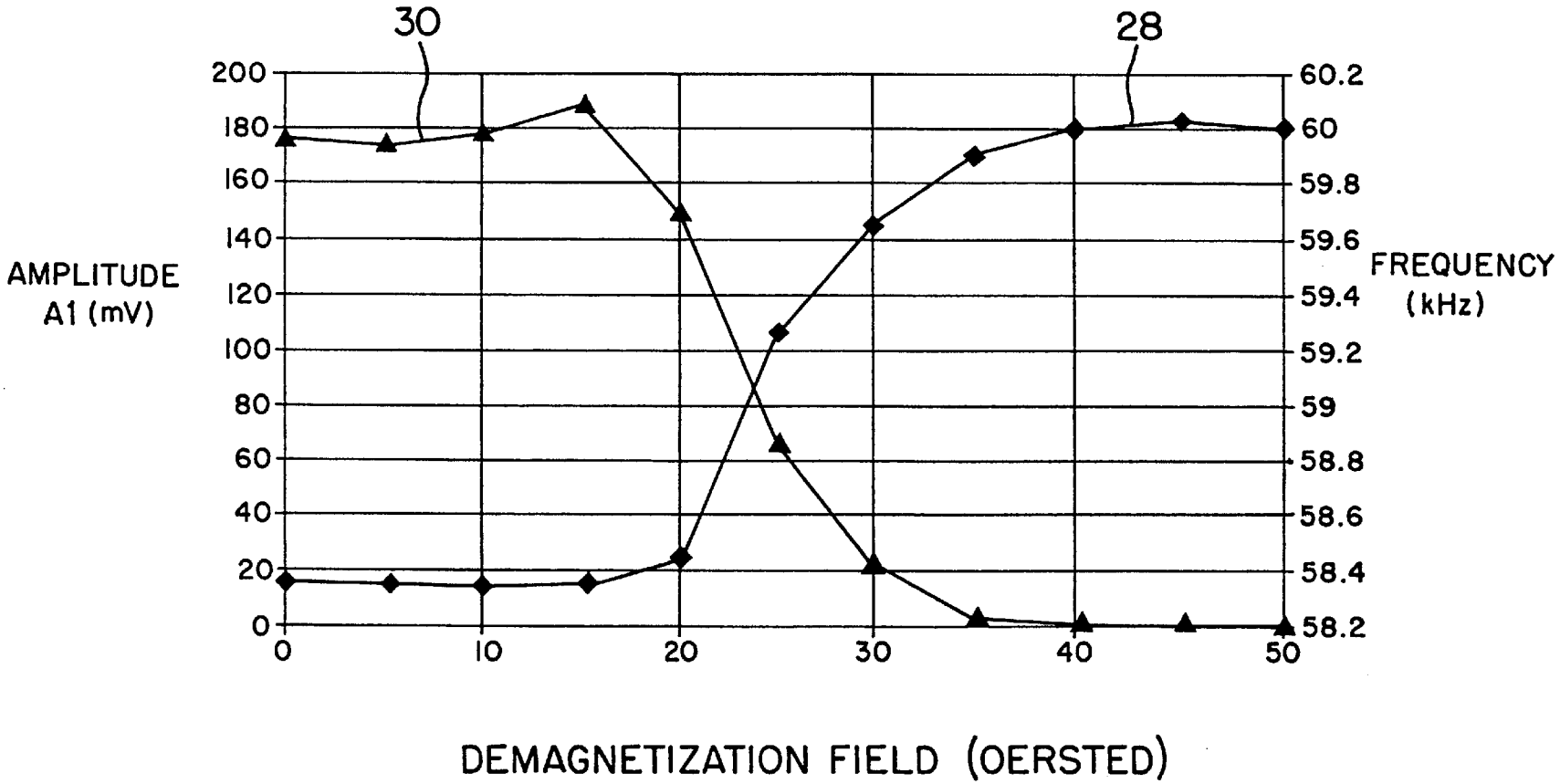
FIG. 7 is a graph similar to FIGS. 2 and 3 and showing changes in resonant frequency and output signal amplitude according to the strength of the applied demagnetization field for a magnetomechanical marker provided in accordance with the second embodiment of the invention.

FIG. 7 presents both resonant-frequency-shift and output signal amplitude characteristics of a marker utilizing the annealed SB1 material as the bias element and the 2628CoA material as the active element. In FIG. 7, curve 28 represents the demagnetization-field-dependent resonant-frequency-shift characteristic of the marker using the SB1 material, and curve 30 represents the output signal amplitude characteristic of the marker. Curve 28 is to be interpreted with reference to the right-hand scale (kHz) and curve 30 with reference to the left-hand scale (mV).

From FIG. 7 it will be observed that when a demagnetization field is applied to the marker incorporating the SB1 material at certain low levels (about 5 to 15 Oe) that would be sufficient to cause a substantial degree of demagnetization of the bias element when standing alone, the marker exhibits substantially no change in its characteristics, especially resonant frequency, and is not deactivated. It is believed that, at these applied demagnetization field levels, there is magnetic coupling between the active element and the bias element, and the active element functions as a flux diverter to shield the SB1 bias element from the demagnetization field. When the applied demagnetization field is above about 15 Oe, the permeability of the active element rapidly decreases, and allows the demagnetization field to degauss the bias element. Consequently, both the frequency-shift and output signal characteristics exhibit substantial stability for demagnetization field levels at around 15 Oe or less, and substantial steepness in the range of 20 to 30 Oe of the demagnetization field. The resonant-frequency-shift characteristic has a slope in excess of 100 Hz/Oe in the 20–25 Oe range. It will also be noted that an applied demagnetization field of less than 50 Oe results in a very substantial resonant frequency shift (more than 1.5 kHz) and virtual elimination of the Al output signal.

Because of the shielding effect provided by the active element, the biasing element may be formed of a rather unstable material which is less expensive than the conventional SemiVac 90 material and also less expensive than the MagnaDur material.

The heat-treatment procedure described above can be changed so that the last hour of annealing is performed at 800° C. rather than 710°, to produce annealed SB1 material having a coercivity of 11 Oe.

According to a third embodiment of the invention, the biasing element 16 of the marker 10 is formed of an alloy designated as Vacozet, and commercially available from Vacuumschmelze GmbH, Gruner Weg 37, D-63450, Hanau, Germany. The Vacozet material has a coercivity of 22.7 Oe and essentially has the composition $Co_{55.40}Fe_{29.92}Ni_{11.lO}Ti_{3.58}$ (atomic percent).

Figure 9:
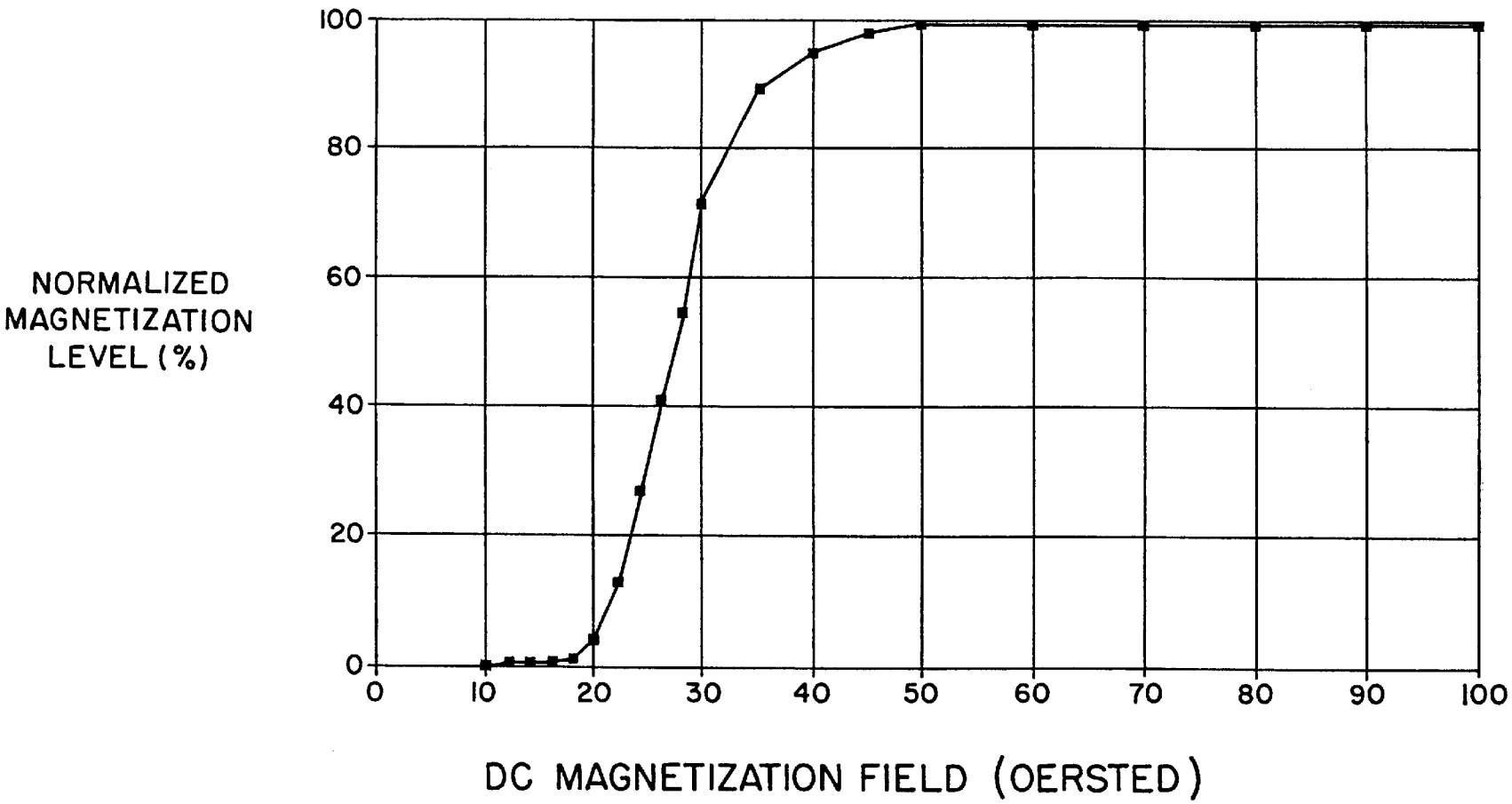
FIG. 9 is a graph similar to FIG. 4, showing how a magnetization level changes, depending on the strength of an applied DC magnetization field, with respect to a material used as a bias element in accordance with a third embodiment of the invention.
Figure 10:
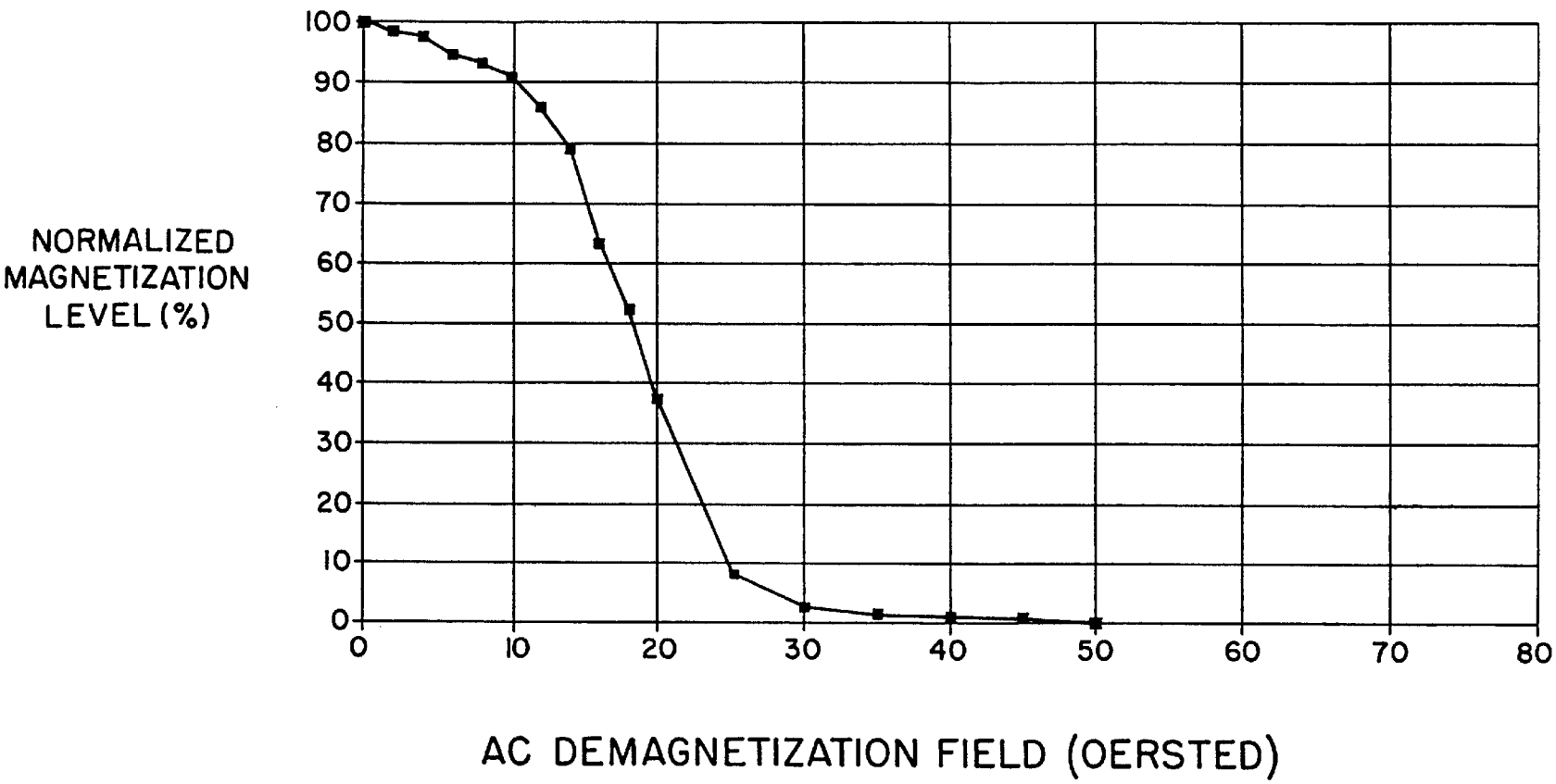
FIG. 10 is a graph similar to FIGS. 5 and 6, showing resulting magnetization levels according to the strength of the applied AC demagnetization field for the bias element material used in the third embodiment of the invention.

A magnetization characteristic of the Vacozet material is illustrated in FIG. 9, and a demagnetization characteristic of the material is shown in FIG. 10. As seen from FIG. 9, a DC field of about 50 Oe is sufficient to substantially completely magnetize the material. FIG. 10 indicates that, if a fully magnetized biasing element of the Vacozet material is subjected to an AC demagnetization field at a level of about 30 Oe, the element is demagnetized to below 5% of full magnetization. Like the SB1 material, the Vacozet material evinces some instability when exposed to low level AC fields, including AC fields having a peak amplitude of 6 to 15 Oe. However, exposure to an AC field having a peak amplitude of 5 Oe or less results in no more than a 5% reduction in magnetization.

Figure 11:
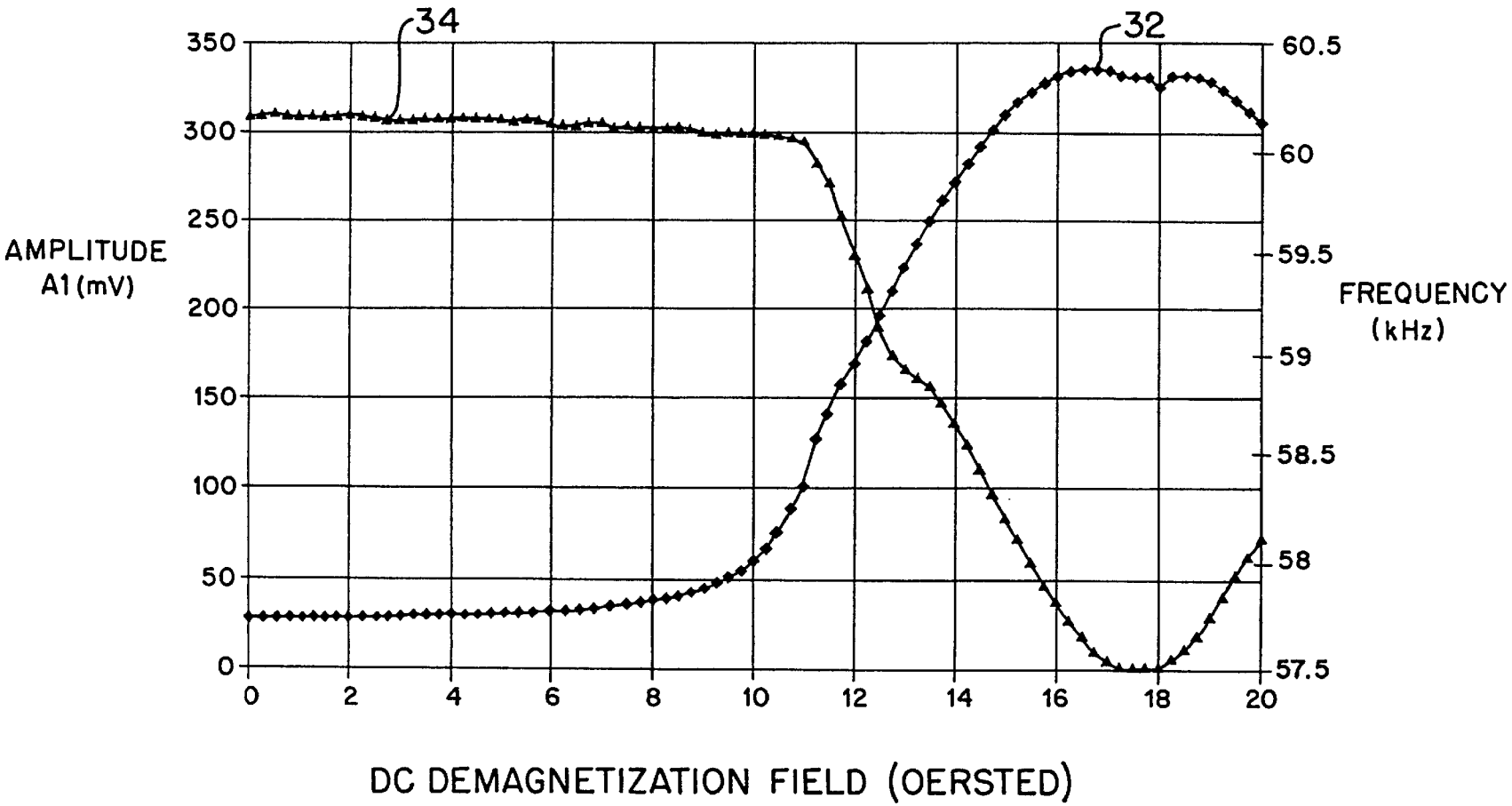
FIG. 11 is a graph similar to FIGS. 2, 3 and 7 and showing changes in resonant frequency and output signal amplitude according to the strength of the applied demagnetization field for a magnetomechanical marker provided in accordance with the third embodiment of the invention.

FIG. 11 presents both resonant-frequency-shift and output signal amplitude characteristics of a marker utilizing the Vacozet material as the bias element and the 2628CoA material as the active element. In FIG. 11, curve 32 represents the demagnetization-field-dependent resonant-frequency-shift characteristic of the marker using the Vacozet material, and curve 34 represents the output signal amplitude characteristic of the marker. Curve 32 is to be interpreted with reference to the right-hand scale (kilohertz) and curve 34 with reference to the left-hand scale (millivolts).

It will be observed from FIG. 11 that the frequency-shift and amplitude characteristic curves exhibit a greater stability at low demagnetization field levels than would be expected from the demagnetization characteristic of the bias material when standing alone, as shown in FIG. 10. That is, the marker embodying the Vacozet material exhibits some of the "shielding" effect that was described above in connection with the SB1 embodiment. However, the Vacozet embodiment exhibits substantial frequency shift at a lower level of applied demagnetization field than the SB1 embodiment, while also exhibiting a steeper (more "abrupt") frequency shift characteristic curve. If the region of the frequency shift characteristic curve 32 of FIG. 11 is examined between the 10 and 14 Oe points, a frequency shift in excess of 1.6 kHz will be observed, indicating a slope in excess of 400 Hz/Oe. An applied demagnetization field having an amplitude of under 20 Oe is sufficient to provide reliable deactivation of the Vacozet embodiment of the marker.

The bias element 16 provided in accordance with the third embodiment is formed into its desired thin configuration by rolling a crystalline form of the Vacozet alloy. Because of the relatively low coercivity of the material, a relatively high flux density is provided, so that the thickness of the material can be reduced relative to conventional bias elements, thereby achieving a reduction in the weight of the material used, and a corresponding cost saving.

As alternatives to the above-discussed MagnaDur, Vacozet and SB1 alloys, it is contemplated to employ other materials for the biasing element 16, including, for example, other materials having characteristics like those shown in FIGS. 4, 5, 6, 9 and 10.

It is also contemplated to use materials other than the continuous-annealed 2628CoA alloy for the active element 12. For example, as-cast Metglas 2826MB, which is a conventional material used as an active element in a magnetomechanical marker, may also be used. The cross-field annealed alloys described in U.S. Pat. No. 5,469,140 may also be used for the active element. Materials produced in accordance with the teachings of application Ser. No. 08/508,580 (filed Jul. 28, 1995, and co-assigned herewith), now U.S. Pat. No. 5,568,125, may also be employed for the active element.

The markers provided in accordance with the present invention are subject to some degree of instability when exposed to low level magnetic fields that would not adversely affect conventional markers. However, it has been found that environmental factors actually experienced by the markers are not such as will unintentionally deactivate markers provided in accordance with the present invention. According to an invention made by Richard L. Copeland, who is one of the applicants of the present application, and Ming R. Lian, who is a co-employee with Dr. Copeland, risks of unintentional deactivation can be reduced by employing a process for magnetization which results in magnetizing the respective bias elements of the markers so that about half of the elements are magnetized with one polarity and the rest are magnetized with an opposite polarity. When a large quantity of markers are stacked together or formed into a roll for shipment or storage, the opposite magnetic polarities tend to cancel, and the accumulation of markers in a small volume does not result in a significant "leakage" field that might tend to demagnetize some of the bias elements.

Figure 8:
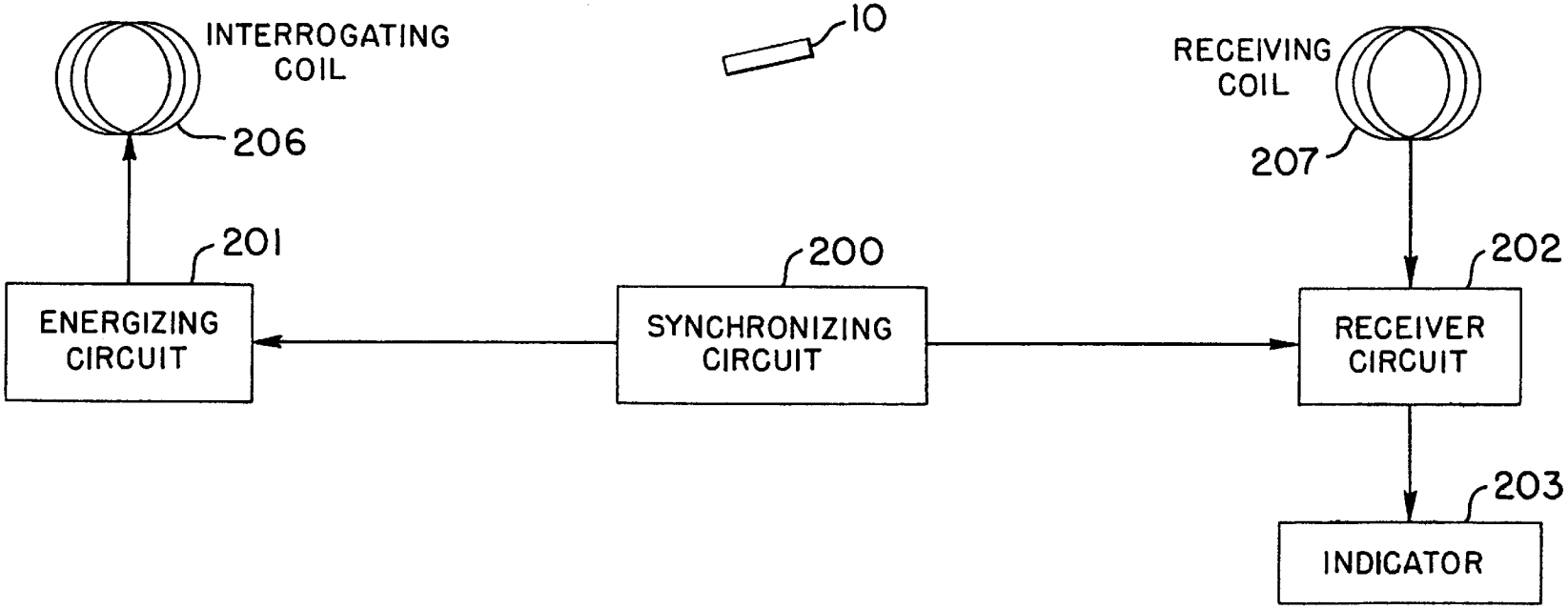
FIG. 8 is a schematic block diagram of an electronic article surveillance system which uses magnetomechanical markers provided in accordance with the invention.

FIG. 8 illustrates a pulsed-interrogation EAS system which uses the magnetomechanical marker fabricated, in accordance with the invention, with a material such as MagnaDur or the annealed SB1 alloy used as the bias element. The system shown in FIG. 8 includes a synchronizing circuit 200 which controls the operation of an energizing circuit 201 and a receiving circuit 202. The synchronizing circuit 200 sends a synchronizing gate pulse to the energizing circuit 201 and the synchronizing gate pulse activates the energizing circuit 201. Upon being activated, the energizing circuit 201 generates and sends an interrogation signal to interrogating coil 206 for the duration of the synchronizing pulse. In response to the interrogation signal, the interrogating coil 206 generates an interrogating magnetic field, which, in turn, excites the marker 10 into mechanical resonance.

Upon completion of the pulsed interrogation signal, the synchronizing circuit 200 sends a gate pulse to the receiver circuit 202 and the latter gate pulse activates the circuit 202. During the period that the circuit 202 is activated, and if a marker is present in the interrogating magnetic field, such marker will generate in the receiver coil 207 a signal at the frequency of mechanical resonance of the marker. This signal is sensed by the receiver 202, which responds to the sensed signal by generating a signal to an indicator 203 to generate an alarm or the like. Accordingly, the receiver circuit 202 is synchronized with the energizing circuit 201 so that the receiver circuit 202 is only active during quiet periods between the pulses of the pulsed interrogation field.

The system depicted in FIG. 8 operates with a single frequency interrogation signal that is generated in pulses. However, it has also been proposed to operate magnetomechanical EAS systems with a swept-frequency or hopping-frequency interrogation signal, and to detect the presence of an activated marker by detecting frequencies at which the variable-frequency interrogation signal is perturbed by the magnetomechanical marker. An example of a swept-frequency system is disclosed in the above-referenced U.S. Pat. No. 4,510,489.

Because of the steep resonant-frequency-shift characteristic of the markers formed in accordance with the present invention, such markers would be particularly suitable for use in magnetomechanical EAS systems which operate by detecting the resonant frequency of the marker rather than the output signal level.

Various other changes in the foregoing marker and modifications in the described practices may be introduced without departing from the invention. The particularly preferred embodiments of the invention are thus intended in an illustrative and not limiting sense. The true spirit and scope of the invention is set forth in the following claims.

What is claimed is:

1. A marker for use in a magnetomechanical electronic article surveillance system, comprising:

(a) an amorphous magnetostrictive element; and (b) a biasing element located adjacent said magnetostrictive element;

wherein said marker has a deactivation-field-dependent resonant-frequency-shift characteristic having a slope that exceeds 100 Hz/Oe and said biasing element is formed of a semi-hard magnetic material having a coercivity $H_c$ of less than 55 Oe.

2. A marker according to claim 1; wherein said deactivation-field-dependent resonant-frequency-shift characteristic has a slope that exceeds 200 Hz/Oe.

3. A marker according to claim 2; wherein said deactivation-field-dependent resonant-frequency-shift characteristic has a slope that exceeds 400 Hz/Oe.

4. A marker according to claim 1; wherein said biasing element is formed of a semi-hard magnetic material having a coercivity Hc of less than 40 Oe.

5. A marker according to claim 4; wherein said biasing element is formed of a semi-hard magnetic material having a coercivity Hc of less than 20 Oe.

6. A marker according to claim 1, wherein said biasing element essentially has a composition selected from the group consisting of:

$Fe_{77.54}Ni_{19.28}Cr_{0.19}Mn_{0.31}Si_{0.30}$;

$Fe_{80.18}Co_{0.20}B_{13.69}Si_{5.82}Mn_{0.11}$; and $Co_{55.40}Fe_{29.92}Ni_{11.10}Ti_{3.58}$ (all expressed in atomic percent).

7. A marker for use in a magnetomechanical electronic article surveillance system, comprising:

(a) an amorphous magnetostrictive element; and (b) a biasing element located adjacent said magnetostrictive element;

wherein said biasing element is formed of a semi-hard magnetic material having a DC magnetization field characteristic such that a DC magnetic field Ha required to achieve saturation of said biasing element is less than 350 Oe;

said semi-hard magnetic material having an AC demagnetization field characteristic such that an AC demagnetization field Hmd having a peak amplitude of less than 150 Oe, when applied to said biasing element with said biasing element being in a fully magnetized condition, demagnetizes said biasing element to a level that is no more than 5% of a full magnetization level.

8. A marker according to claim 7; wherein said AC demagnetization field characteristic of said bias element is such that when said biasing element is in a fully magnetized condition and is exposed to an AC field Hms having a peak amplitude of 4 Oe, said biasing element remains magnetized at a level that is at least 95% of a full magnetization level.

9. A marker according to claim 8; wherein said DC magnetization field characteristic is such that said DC magnetic field Ha required to achieve saturation of said biasing element is less than 200 Oe.

10. A marker according to claim 9; wherein said DC magnetization field characteristic is such that said DC magnetic field Ha required to achieve saturation of said biasing element is less than 150 Oe.

11. A marker according to claim 10; wherein said DC magnetization field characteristic is such that said DC magnetic field Ha required to achieve saturation of said biasing element is less than 50 Oe.

12. A marker according to claim 7, wherein said biasing element essentially has a composition selected from the group consisting of:

$Fe_{77.54}Ni_{19.28}Cr_{0.19}Mn_{0.31}Si_{0.30}$;

$Fe_{80.18}Co_{0.20}B_{13.69}Si_{5.82}Mn_{0.11}$; and $Co_{55.40}Fe_{29.92}Ni_{11.10}Ti_{3.58}$ (all expressed in atomic percent).

13. A method of activating and deactivating an EAS marker for use with a magnetomechanical EAS system, the method comprising the steps of:

providing an EAS marker formed of a magnetostrictive element and a biasing element mounted adjacent the magnetostrictive element, said biasing element formed of a semi-hard magnetic material having a coercivity $H_c$ of less 55 Oe;

magnetizing said biasing element so that said biasing element provides a magnetic field to bias said magnetostrictive element for resonance at an operating frequency of said EAS system; and deactivating said EAS marker by exposing said marker to an AC field having a peak amplitude of less than 150 Oe.

14. A method according to claim 13, wherein said marker has a resonance characteristic that is substantially unchanged when said marker is exposed to an AC field having a peak amplitude of 4 Oe or less.

15. A method according to claim 14, wherein said marker has a resonance characteristic that is substantially unchanged when said marker is exposed to an AC field having a peak amplitude of 20 Oe or less.

16. A method according to claim 14, wherein said deactivating step is accomplished by exposing said marker to an AC field having a peak amplitude of less than 100 Oe.

17. A method according to claim 16, wherein said marker has a resonance characteristic that is substantially unchanged when said marker is exposed to an AC field having a peak amplitude of 12 Oe or less.

18. A method according to claim 13, wherein said magnetizing step is performed after said biasing element is mounted in said marker.

19. A method according to claim 13, wherein said magnetizing step is performed before said biasing element is mounted in said marker.

* * * * *

US006181245C1

(12) EX PARTE REEXAMINATION CERTIFICATE (6141st)

United States Patent

Copeland et al.

(10) Number: US 6,181,245 C1

(45) Certificate Issued: *Mar. 4, 2008

(54) MAGNETOMECHANICAL ELECTRONIC ARTICLE SURVEILLANCE MARKER WITH BIAS ELEMENT HAVING ABRUPT DEACTIVATION/MAGNETIZATION CHARACTERISTIC

(75) Inventors: Richard L. Copeland, Boca Raton, FL (US); Kevin R. Coffey, Morgan Hill, CA (US)

(73) Assignee: Sensormatic Electronics Corporation, Boca Raton, FL (US)

Reexamination Request:
No. 90/007,851, Dec. 14, 2005

Reexamination Certificate for:

| | |
|---|---|
| Patent No.: | **6,181,245** |
| Issued: | **Jan. 30, 2001** |
| Appl. No.: | **08/912,058** |
| Filed: | **Aug. 15, 1997** |

( * ) Notice: This patent is subject to a terminal disclaimer.

Related U.S. Application Data

(63) Continuation-in-part of application No. 08/697,629, filed on Aug. 28, 1996, now Pat. No. 5,729,200.

(51) Int. Cl.
*G08V 13/24* (2006.01)

(52) U.S. Cl. ..... 340/551; 340/572.3

(58) Field of Classification Search ..... 340/551, 340/572.3

See application file for complete search history.

(56) References Cited

U.S. PATENT DOCUMENTS

| | | | | |
|---|---|---|---|---|
| 4,510,489 | A | 4/1985 | Anderson, III | 340/572 |
| 5,351,033 | A | 9/1994 | Liu et al. | 340/572 |
| 5,431,746 | A | 7/1995 | Manning et al. | 148/122 |
| 5,495,230 | A | 2/1996 | Lian | 340/551 |
| 5,527,399 | A | 6/1996 | Manning et al. | 148/120 |
| 5,628,840 | A | 5/1997 | Hasegawa | 148/304 |
| 5,650,023 | A | 7/1997 | Hasegawa et al. | 148/304 |
| 5,653,824 | A | 8/1997 | Manning et al. | 148/306 |
| 5,767,770 | A | 6/1998 | Gadonniex | 340/551 |
| 5,870,021 | A | 2/1999 | Gadonniex | 340/551 |

FOREIGN PATENT DOCUMENTS

| | | |
|---|---|---|
| EP | 0 696 784 A1 | 2/1996 |
| WO | WO 96/325518 | 10/1996 |

OTHER PUBLICATIONS

Boll, et al., 1979 *Soft Magnetic Materials: The Vacuumschemetz Handbook*; pp. 106–107.

Boll, et al., 1990, *Weichmagnetische Werkstoffe: Einführung in den Magnetismus*; pp. 184; 395–397.

Boll, et al., 1990, English Translation Of: *Weichmagnetische Werkstoffe: Einfürung in den Magnetismus*; pp. 184; 395–397.

Bozorth, 1951, *Ferromagnetism*; pp. 1–13.

1996, Carpenter Technology MagneDur 20–4 Product Datasheet.

1984, The IEEE Standard Dictionary of Electrical and Electronics Terms; p. 233.

2000, ANS T1.523–2001, Telecom Glossary 2000: entries "degauss", "degaussing" and "demagnetizable"; http://www.its.bldrdoc.gov/projects/devglossary/t1g2k.html.

Arnold Engineering Co., 2003, *Precision Rolled Strip and Foil*; pp. 16.15–16.16.

*Primary Examiner*—Ovidio Escalante

(57) ABSTRACT

A material used to form a biasing element for a magnetomechanical EAS marker has a coercivity that is lower than the coercivity of biasing elements used in conventional magnetomechanical markers. The marker formed with the low coercivity material can be deactivated by applying an AC magnetic field at a level that is lower than is required for deactivation of conventional markers. The marker with the low coercivity bias element can also be deactivated when at a greater distance from a deactivation device than was previously practical.

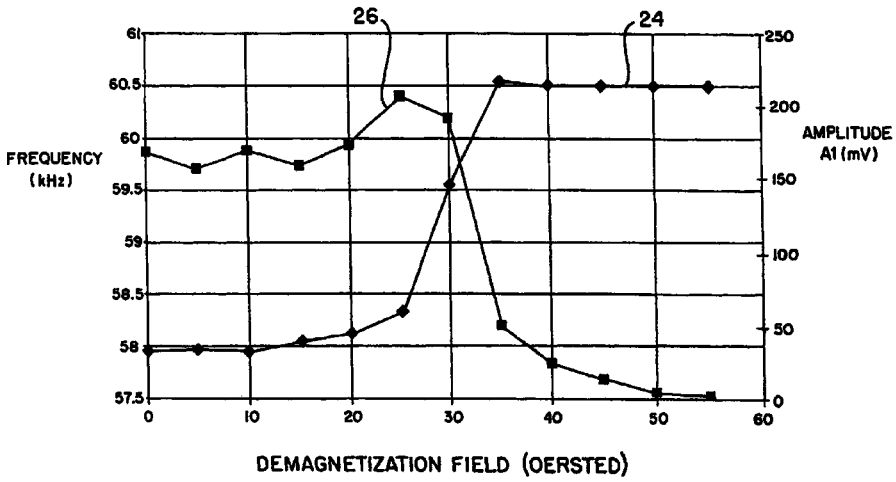

EX PARTE REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

The patentability of claims 1–12 and 14–17 is confirmed.

Claim 13 is cancelled.

Claims 18 and 19 are determined to be patentable as amended.

18. A method according to claim [13] *14*, wherein said magnetizing step is performed after said biasing element is mounted in said marker.

19. A method according to claim [13] *14*, wherein said magnetizing step is performed before said biasing element is mounted in said marker.

* * * * *